US005918336A

United States Patent [19]

Lee et al.

[11] Patent Number: 5,918,336

[45] Date of Patent: Jul. 6, 1999

[54] STRUCTURE OF ALTERNATELY INFLATED/ DEFLATED AIR BED

[75] Inventors: Daniel Lee; Terry Tu, both of Taipei, Taiwan

[73] Assignee: Apex Medical Corp., Hsi-Chin Taipei, Taiwan

[21] Appl. No.: 08/892,432

[22] Filed: Jul. 14, 1997

[51] Int. Cl.[6] ..... A47C 27/10; A61G 7/057

[52] U.S. Cl. ..... 5/713; 5/706; 5/710; 5/712; 5/713

[58] Field of Search ..... 5/706, 710, 713, 5/712, 715

[56] References Cited

U.S. PATENT DOCUMENTS

| | | | |
|---|---|---|---|
| 2,318,492 | 5/1943 | Johnson | 5/712 |
| 3,674,019 | 7/1972 | Grant | 5/713 X |
| 4,225,989 | 10/1980 | Corbett et al. | 5/713 |
| 4,391,009 | 7/1983 | Schild et al. | 5/714 X |
| 5,044,030 | 9/1991 | Balaton | 5/710 |
| 5,097,552 | 3/1992 | Viesturs | 5/712 X |
| 5,142,717 | 9/1992 | Everard et al. | 5/713 X |
| 5,243,723 | 9/1993 | Cotner et al. | 5/710 |
| 5,425,147 | 6/1995 | Supplee et al. | 5/713 |
| 5,651,151 | 7/1997 | Schild | 5/713 X |
| 5,685,036 | 11/1997 | Kopfstein et al. | 5/710 X |
| 5,774,917 | 7/1998 | Liu | 5/715 |

*Primary Examiner*—Michael F. Trettel
*Assistant Examiner*—Robert G. Santos
*Attorney, Agent, or Firm*—Bacon & Thomas, PLLC

[57] ABSTRACT

An alternately inflated/deflated air bed being made by an arrangement of many air bag sets, each of them provided therein with a first air bag which is further provided therein with a second air bag. The first air bag thus is divided into two air chambers. An air pipe is provided on the first air bag for air intake and discharge. The second air bag is constantly kept inflated. The air bag sets are arranged in series. When the air bag sets of the odd and of the even numbers are alternately inflated/deflated by simultaneous discharge or intake of the two air chambers, the first air bags are inflated/deflated twice as much, so that a patient lying on the air bed obtains adequate ventilation by alternately changing contact points of his body with the air bed. When there is a power loss or machine failure which causes the first air bags to discharge, the second air bags support the patient to still feel comfortable.

6 Claims, 10 Drawing Sheets

STRUCTURE OF ALTERNATELY INFLATED/DEFLATED AIR BED

BACKGROUND OF THE INVENTION

1. Field of the Invention

The present invention is related to an improved structure of an alternately inflated/deflated air bed, and especially to an improvement that is applied in clinical medicine to help a patient lying on a bed for a long period to avoid obtaining pressure sores and decubitus ulcers by alternately changing contact points of his body with the bed to obtain adequate ventilation of the skin of his body. The air bed is made by an arrangement of a plurality of bag sets. Each air bag set is provided therein with a first air bag which has a second air bag therein, so that the first air bag is divided into two air chambers A, B. When the air chambers A, B are inflated or deflated simultaneously, the first air bag is inflated or deflated twice as much to increase ventilation effect. When the first air bag is deflated automatically because of a power loss or machine failure, the second air bag keeps the patient comfortable.

2. Description of the Prior Art

As shown in FIG. 1 and 2, conventionally, the body of the patient lying on a bed for a long period can be provided with adequate ventilation for the skin of his body by alternately changing contact points of his body with an air bed to avoid obtaining pressure sores and decubitus ulcers. In the conventional air bed, a plurality of air bags 10 are arranged on a hard plate. The air bags 10 of the odd numbers and those of the even numbers have their intake (discharge) holes 11 connected to an air pump. A switch is used to control simultaneous or alternate discharge or intake of the air bags 10 of the odd numbers and of the even numbers to alternate the contact points of the patient to avoid obtaining pressure sores and decubitus ulcers.

However, once there is a power loss or machine failure, air in the air bags will be released gradually, so that the body of the patient will come into contact with the hard plate directly, and the patient will feel uncomfortable.

Hence an "AIR BED WITH ALTERNATELY RAISED/LOWERED UNITED AIR BAGS" (patent application No. 84204580 filed in Taiwan, R.O.C.) as depicted in FIG. 1 was provided in the markets which is an improvement directed to the above stated defect. This air bed is similarly provided with a plurality of air bag sets 20, wherein, each air bag set 20 is divided by a transverse diaphragm 21 into an upper air chamber 22 and a lower air chamber 23. Air in the lower air chamber 23 is kept fully inflated, while the upper air chamber 22 is alternately raised or lowered by input and extraction of air by a pump. Once there is a power loss or machine failure, the inflated condition in the lower air chamber 23 prevents the patient lying on the air bed from direct contact with the hard plate.

However, only the upper air chamber 22 of the air bag set 20 has the function of air inflation/deflation, so that the vertical range that it is raised or lowered equals the height of the upper air chamber 22; this means that, while the improved air bed can make the patient more comfortable when there is a power loss or machine failure, if it is an alternate inflation/deflation mode, the space available for ventilation can only be provided in the height of the upper air chamber 22. Thus, the possible effect of ventilation and heat sinking is much inferior to that of a conventional air bed, and is only half of the latter. A patient with inferior circulation of blood lying on the air bed may still get pressure sores and decubitus ulcers induced thereby.

Moreover, when there is a power loss or machine failure, air in the upper air chamber 22 will be discharged automatically and the surface of the air bed will be flattened (as is shown in FIG. 4). The patient lying on the air bed will directly contact the flattened air bed resulting in bad ventilation. If the power loss or machine failure can not be corrected, the patient may get pressure sores and decubitus ulcers.

Additionally, the conventional air bed and the above stated improved air bed have a common defect that, when the neighboring air bags are alternately inflated/deflated, the air bags being deflated are pressed by two neighbouring air bags in the state of inflation and thus are not lowered properly. This results in an overly small ventilation space. Therefore, the effect of ventilation and heat sinking is inferior.

SUMMARY OF THE INVENTION

In view of these disadvantages, the principal object of the present invention is to provided an improved structure of an alternately inflated/deflated air bed. The air bed is made by an arrangement of a plurality of air bag sets, each of which is provided therein with a first air bag having a second air bag therein, so that the first air bag is divided into two air chambers A, B. An air pipe is provided at a suitable position on the first air bag for intake and discharge of the first air bag. The second air bag is kept inflated. In the series of the air bag sets of the air bed, the air bag sets of the odd numbers and of the even numbers are alternately inflated/deflated, by simultaneous discharge or intake of the two air chambers A, B. The first air bags are inflated or deflated twice as much, so that a patient lying on the air bed obtains an adequate ventilation effect by alternately changing contact points of his body with the air bed.

Another object of the present invention is to provide an improved structure of an alternately inflated/deflated air bed, wherein, when there is a power loss or machine failure which causes the first air bags to discharge automatically and gradually, the second air bags support the patient lying on the air bed preventing direct contact with the hard plate thereunder and a resulting uncomfortable feeling.

Another object of the present invention is to provide an improved structure of an alternately inflated/deflated air bed, wherein, each of the second air bags has a round or elliptical vertical cross-section. Where there is a power loss or machine failure which causes the first air bags to discharge automatically and gradually, the neighbouring second air bags still have small gaps therebetween for ventilation.

A further object of the present invention is to provide an improved structure of an alternately inflated/deflated air bed, wherein, the second air bags are filled therein with liquid heavier than air to give the second air bags suitable weight. When the air bag sets of the odd numbers and of the even numbers are alternately inflated/deflated, the second air bags press down the first air bags to increase discharging speed, and to increase spaces for ventilation and heat sinking, and thus to provide a good ventilation and heat sinking effect.

The present invention will become more apparent in its detailed structure as well as other objects thereof after reading the detailed description of the preferred embodiment thereof with reference to the accompanying drawings.

DETAILED DESCRIPTION OF THE PREFERRED EMBODIMENT

Figure 5:
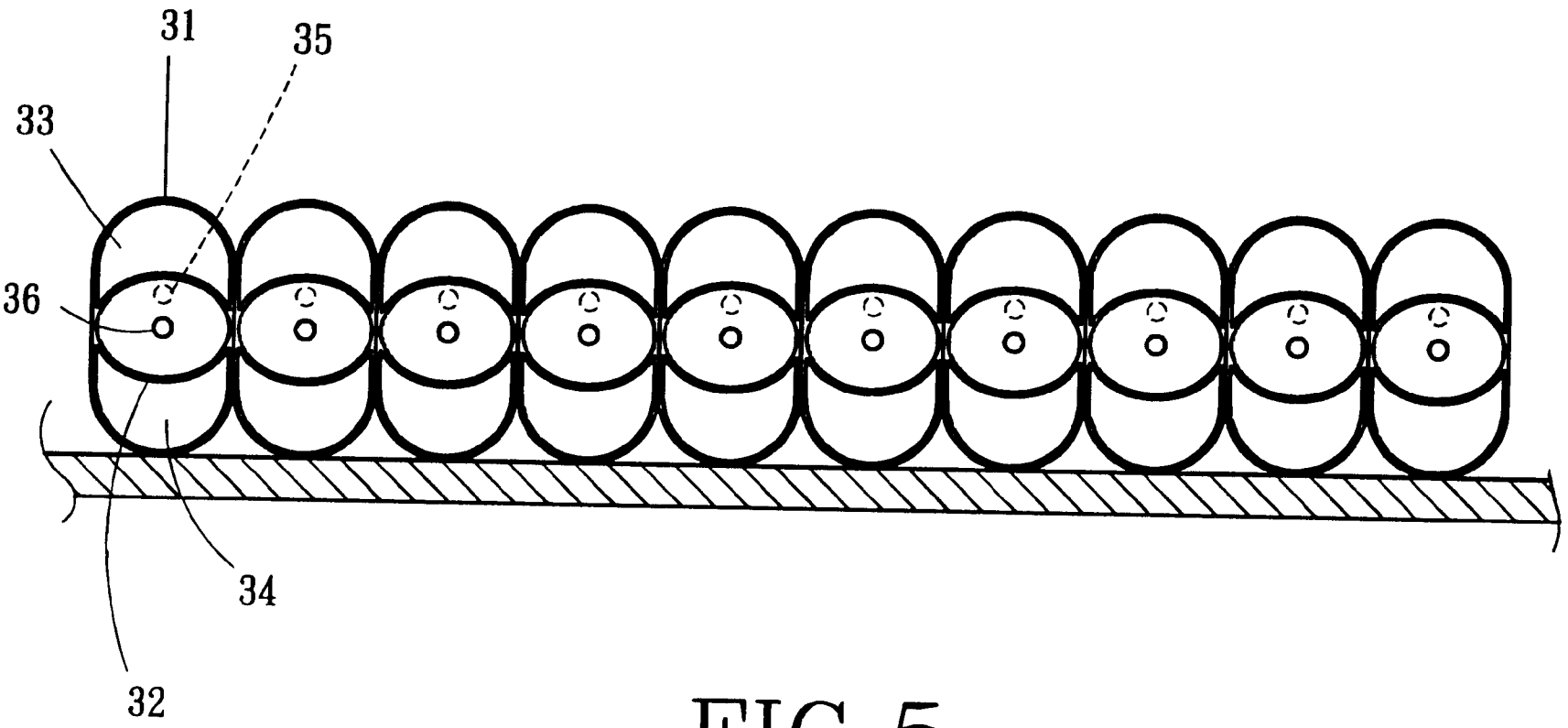
FIG. 5 is a sectional view of the present invention.
Figure 6:
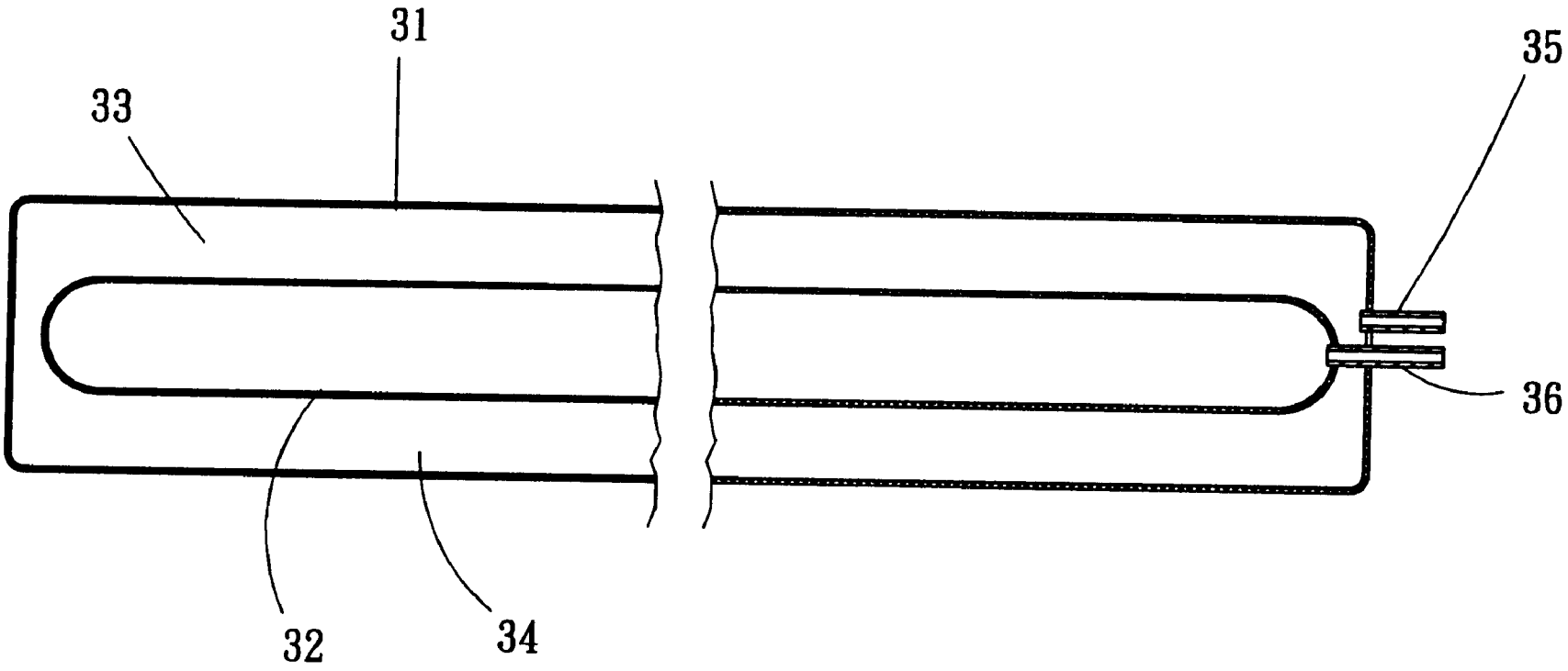
FIG. 6 is a sectional side of an air bag set of the present invention.
Figure 9:
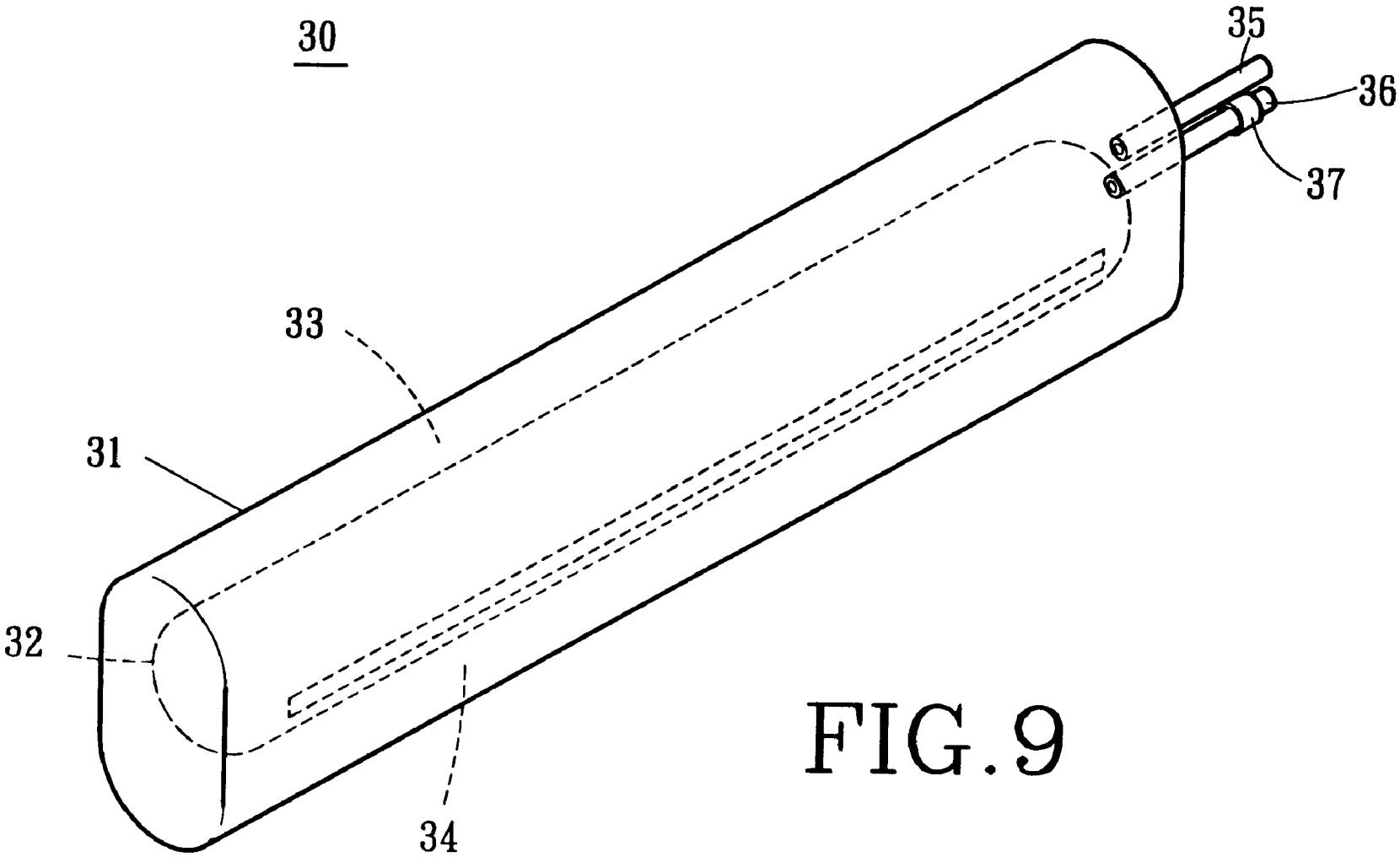
FIG. 9 is a perspective view of an air bag set of the present invention.

Referring to FIG. 5 together with FIG. 6 and 9 of the drawings, the improved structure of an alternately inflated/deflated air bed of the present invention is made by an arrangement of a plurality of air bag sets 30 each of which is provided therein with a first air bag 31 which is further provided therein with a second air bag 32 connected therewith. The first air bag 31 is divided into an air chamber A which is numbered with 33 and an air chamber B which is numbered with 34. The air bag 31 is not completely connected with the second air bag 32 (such as is shown in FIG. 6). The air chambers 33, 34 are in communication with each other. An air pipe 35 is provided at a suitable position on the first air bag 31 for the purpose of air intake and discharge of the first air bag 31. The second air bag 32 is constantly kept inflated. An intake pipe 36 is provided at suitable position on the second air bag 32 and is provided with a reverse stop valve 37 at a suitable position thereon so that air can only be taken in but not discharged.

Figure 7:
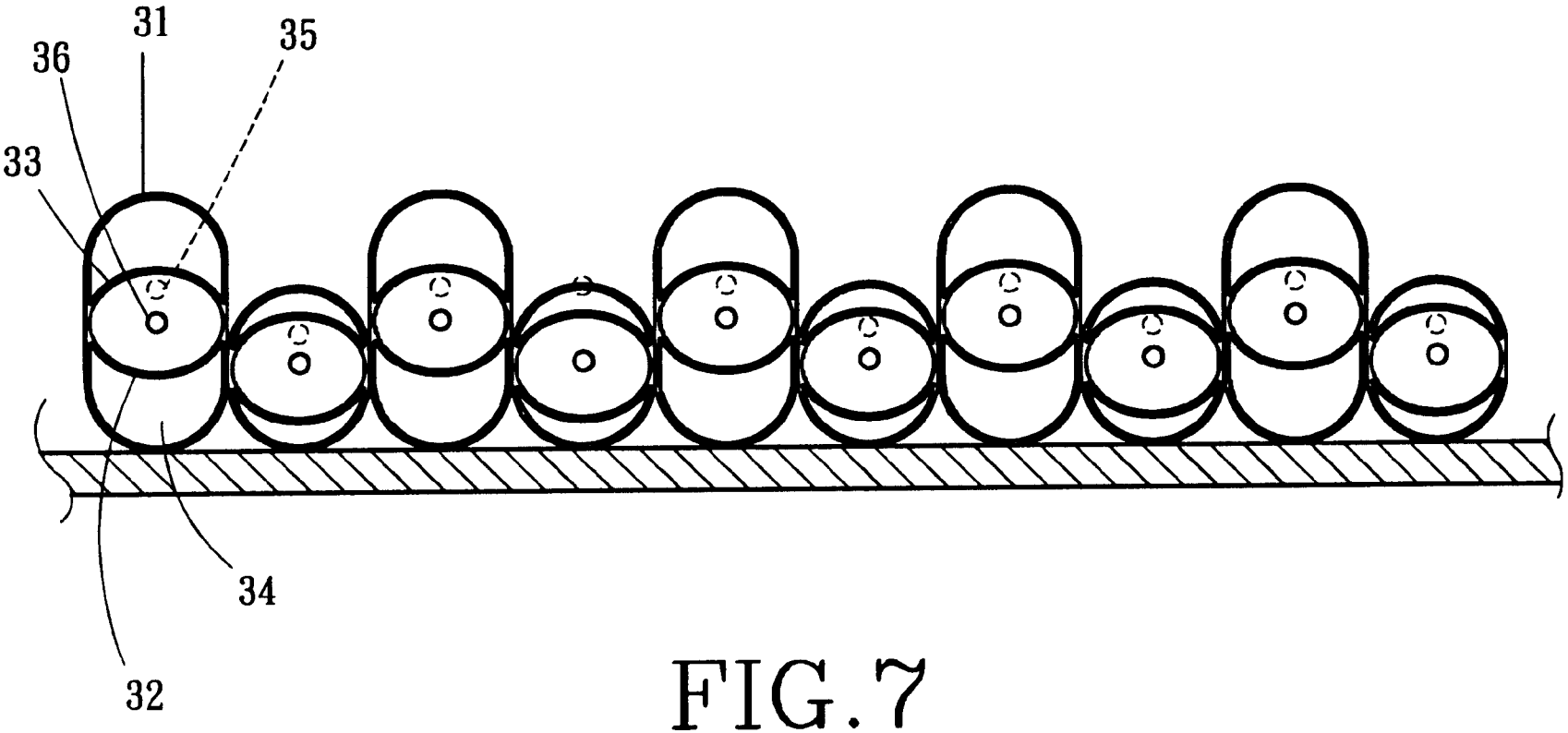
FIG. 7 is a schematic side view of the present invention showing the function of inflation/deflation of the air bag sets.

As shown in FIG. 7, the air bag sets 30 of the present invention are arranged to connect the air pipes 35 of the air bag sets 30 of the odd numbers and of the even numbers to the intake or discharge port of an air pump to alternately intake or discharge air. When the air chambers 33, 34 are inflated or deflated simultaneously, the first air bags 31 are inflated or deflated twice as much to increase the ventilation effect, so that a patient lying on the air bed receives an adequate ventilation effect by alternately changing contact points of his body with the air bed.

Figure 8:
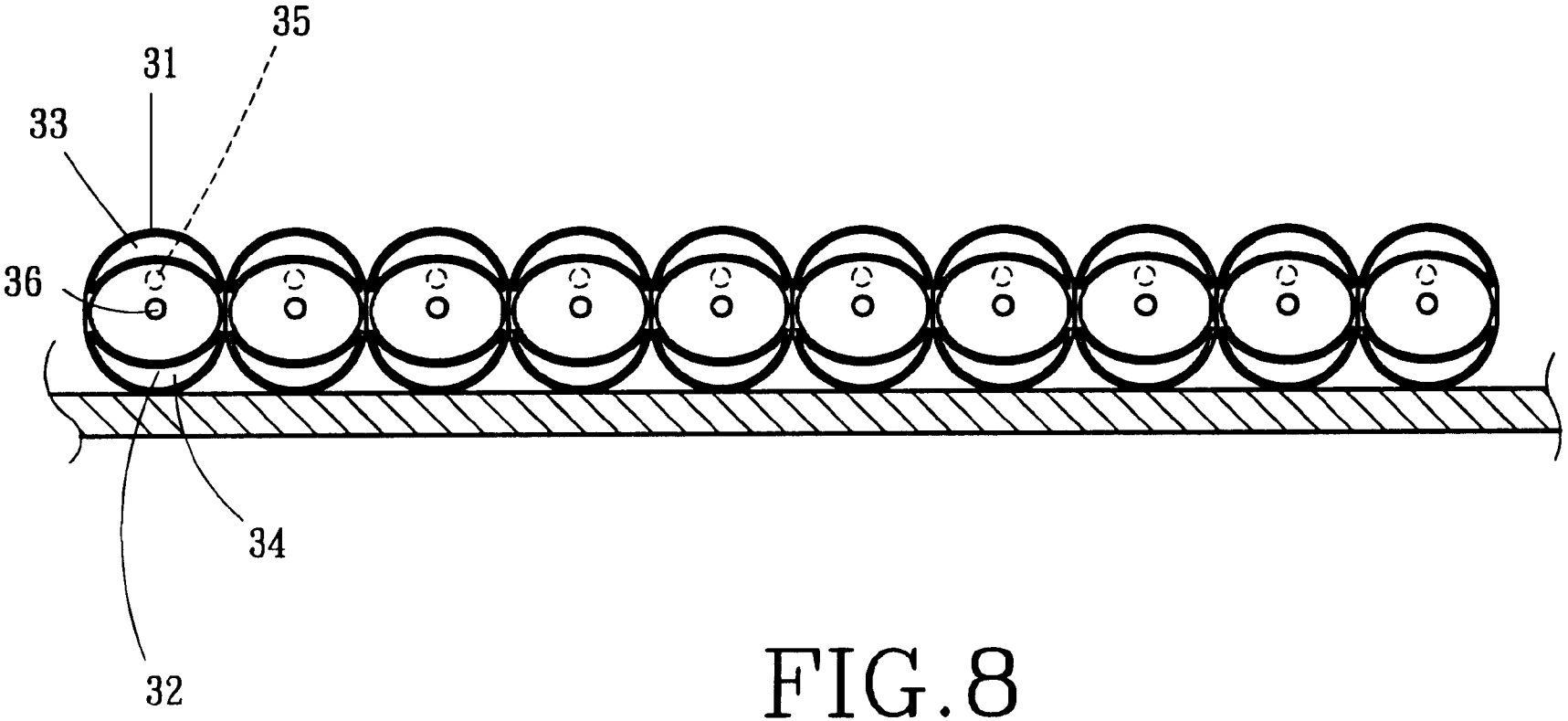
FIG. 8 is a sectional view of the present invention showing the state after a power loss or machine failure which causes the first air bags to discharge automatically.

As shown in FIG. 8, when the first air bags 31 are deflated automatically because of a power loss or machine failure, the second air bags 32 keep the patient comfortable. The second air bags 32 may have a round or elliptical cross-section so that small gaps still remain for ventilation even when there is a power loss or machine failure.

Moreover, the second air bags 32 may be filled therein with liquid heavier than air to increase their weight. When the air bag sets 30 of the odd numbers and of the even numbers are alternately inflated/deflated, the second air bags 32 having appropriate weight press down the first air bags 31 to increase discharging speed, and to increase spaces for ventilation and heat sinking, and thus to provide a good ventilation and heat sinking effect.

Figure 1:
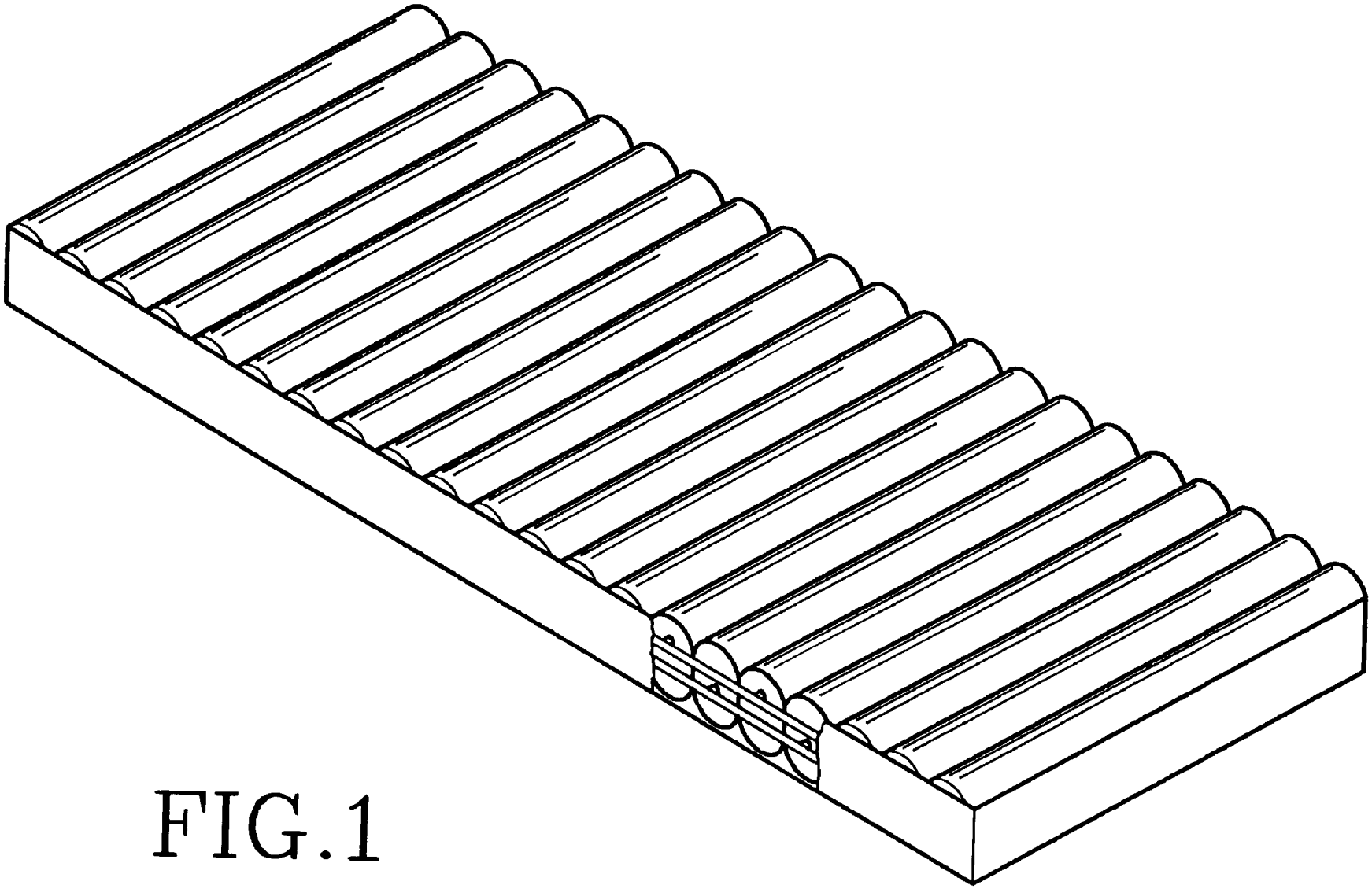
FIG. 1 is a schematic view of the conventional air bed.
Figure 2:
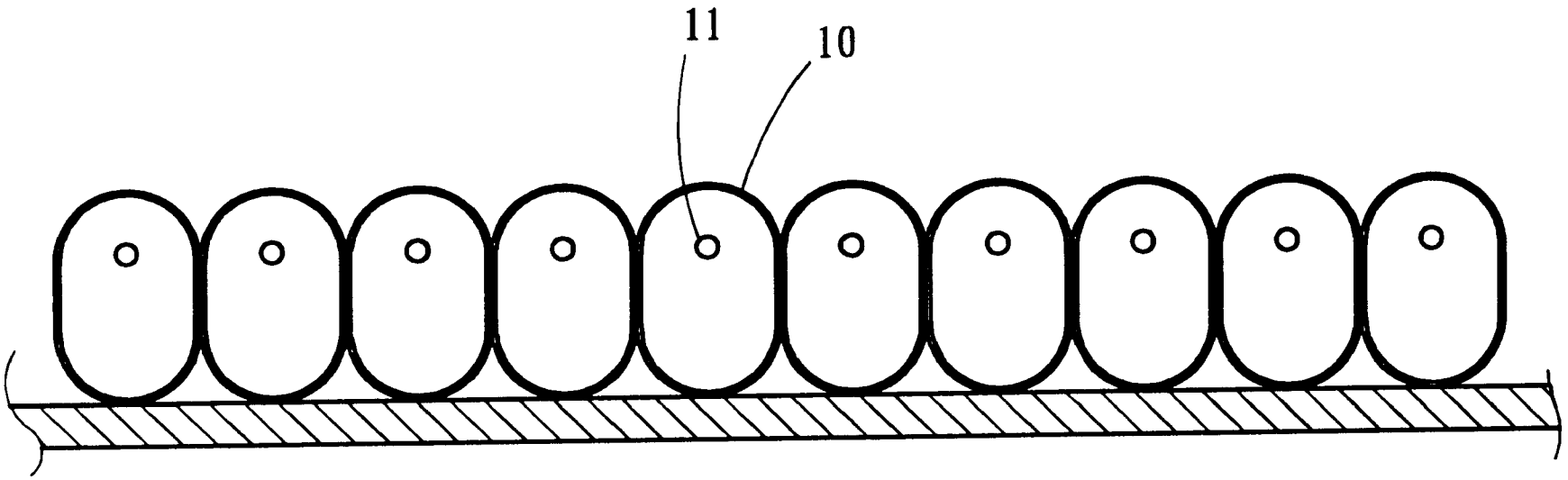
FIG. 2 is a sectional view of the conventional air bed.
Figure 3:
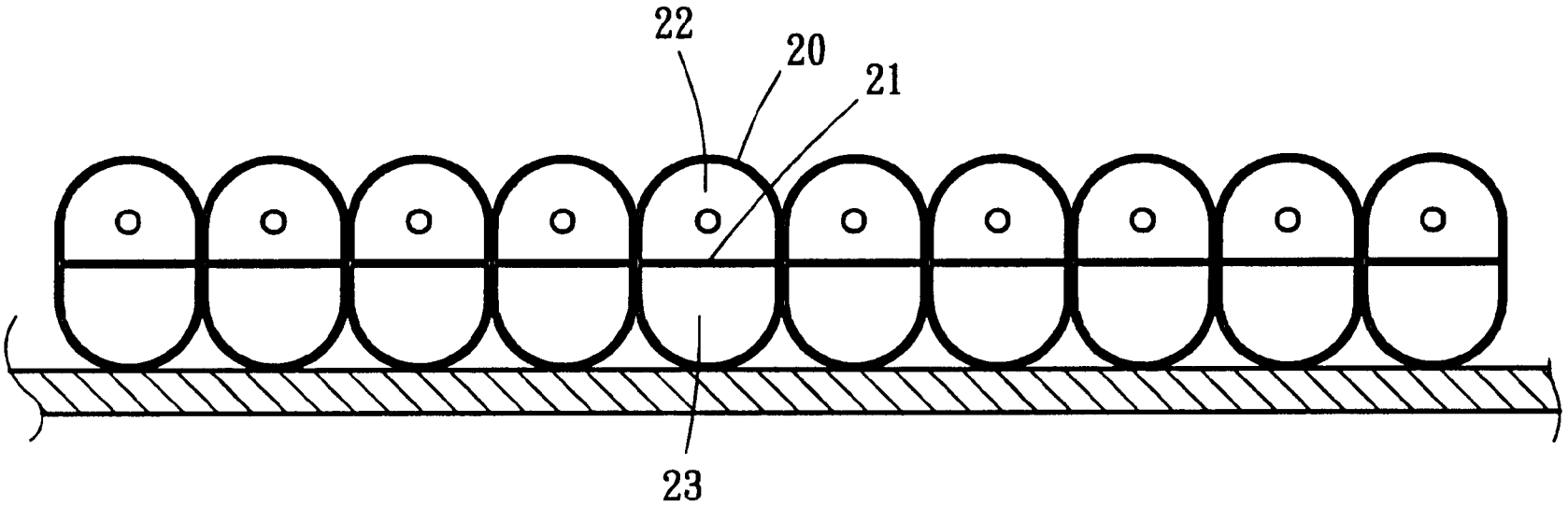
FIG. 3 is a sectional view of the improved air bed of the prior art.
Figure 4:
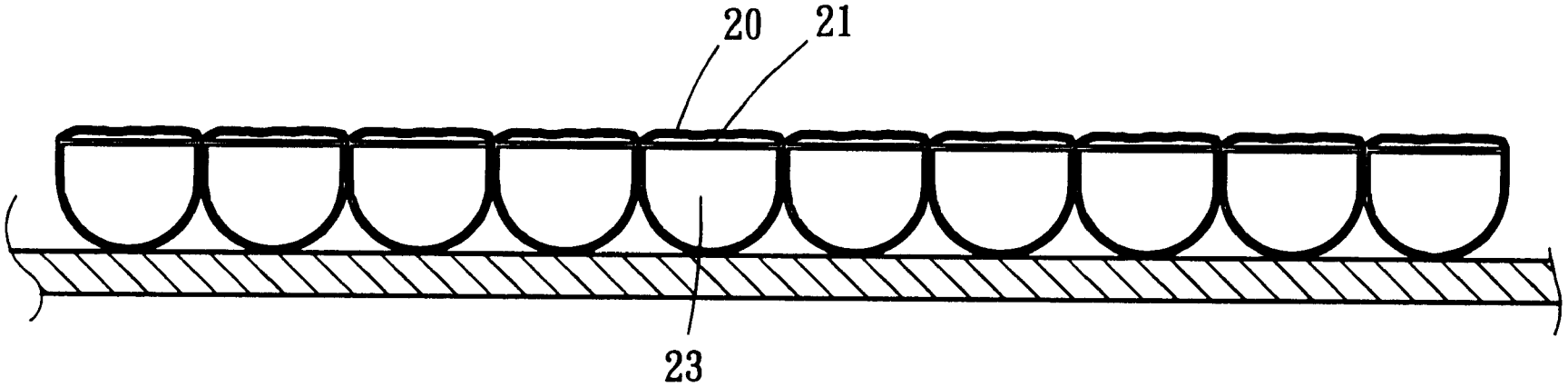
FIG. 4 is a sectional view of the improved air bed of FIG. 3 showing the state when there is a power loss or machine failure which causes the air chambers to discharge automatically.
Figure 10:
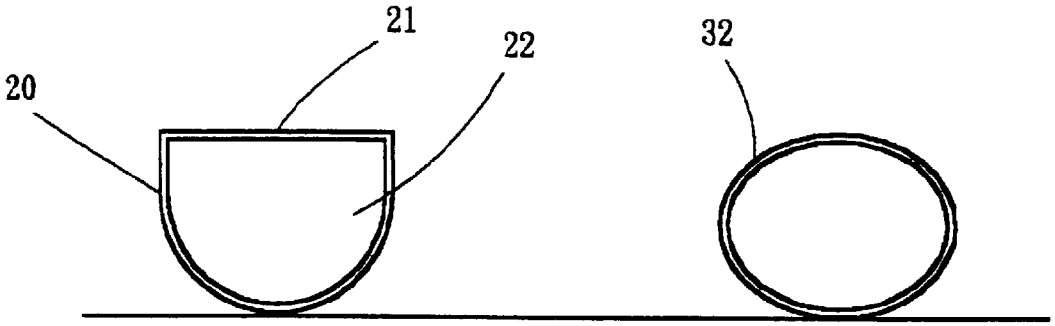
FIG. 10 is a view showing the difference between one of the second air bags of the present invention constantly being kept in the inflated condition and one of the lower chambers of the improved air bed as shown in FIG. 3.
Figure 11:
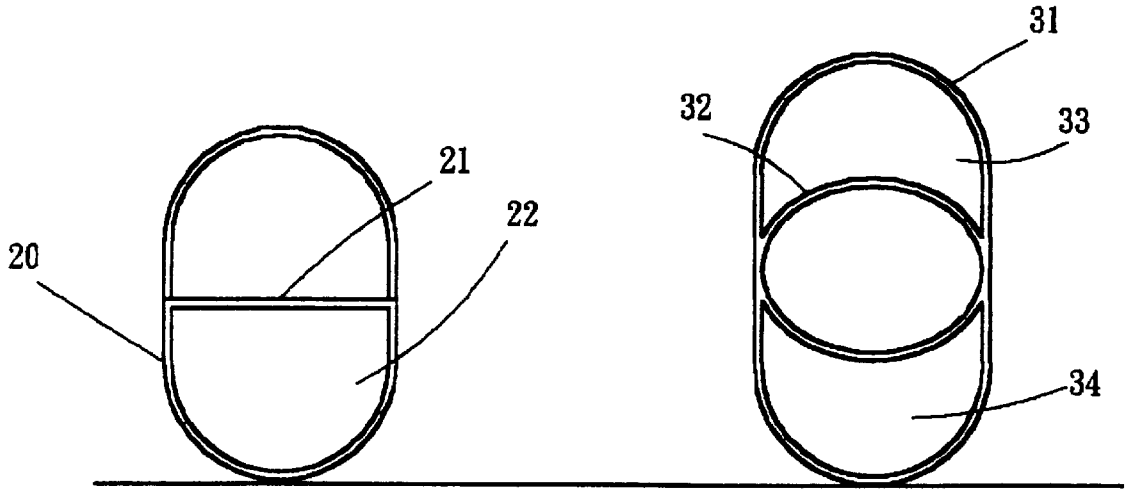
FIG. 11 is a view showing the difference in height between one of the air bag sets of the present invention and one of the air bag sets of the improved air bed as shown in FIG. 3.

And as shown in FIG. 10 and 11, the second air bag 32 constantly kept in the inflated condition is identical in the height of its section to the lower air chamber 23 of the improved air bed as shown in FIG. 3. When the first air bag 31 and the upper air chamber 22 are inflated, the total height of the air bag set 30 of the present invention is about 1.5 times the total height of the air bag 20 of the improved air bed. This assures that the present invention can provide larger gaps for ventilation during alternate inflation/deflation. The effect is much larger than that of the prior art improvement and the conventional air beds as well.

Additionally, when the reverse stop valve 37 provided on the second air bag 32 is removed, the air pipes 35 of the first air bags 31 and the intakes 36 of the second air bags 32 may be communicated mutually to function as conventional air bags.

In conclusion, the structural feature of the present invention certainly improves practical function of air beds; therefore, what we claim as novel and desired to be secured by Letter Patents of the united states is:

1. An improved structure of an alternately inflated/deflated air bag for an air bed, said structure comprising:

an arrangement of a plurality of air bag sets which are alternately inflatable/deflatable;

each of said air bag sets including a first air bag and a second air bag, said second air bag being provided within said first air bag and connected therewith such that said first air bag is divided into two air chambers in fluid communication with each other, said first air bag and said second air bag not being in fluid communication with each other;

and an air pipe on each of said first air bags which effectuates air intake and discharge of each of said first air bags for alternate inflation/deflation of said air bag sets, each of said second air bags always being fully inflated;

wherein when there is a power loss or a machine failure which causes all of said first air bags to discharge automatically and gradually, said fully inflated second air bags prevent a patient lying on said air bags from coming into direct contact with hard members underneath said air bed.

2. An improved structure of an alternately inflated/deflated air bag according to claim 1, further comprising;

an intake pipe provided on each of said second air bags, said air intake pipe including a reverse stop valve which allows air to be taken in but not discharged.

3. An improved structure of an alternately inflated/deflated air bag according to claim 1, wherein said second air bags are filled with a liquid heavier than air so that when said air bag sets are alternately inflated/deflated, said second air bags press down said first air bags being deflated.

4. An improved structure of an alternately inflated/deflated air bag according to claim 1, wherein said second air bags have a round cross-section.

5. An improved structure of an alternately inflated/deflated air bag according to claim 1, wherein said second air bags have an elliptical cross-section.

6. An improved structure of an alternately inflated/deflated air bag according to claim 2, wherein said air pipes of said first air bags and said intake pipes of said second air bags are mutually communicable such that said air bags are alternatively functional as conventional air bags.

* * * * *

UNITED STATES PATENT AND TRADEMARK OFFICE

CERTIFICATE OF CORRECTION

PATENT NO. : 5,918,336
DATED : July 6, 1999
INVENTOR(S) : Daniel Lee and Terry Tu It is certified that error appears in the above-identified patent and that said Letters Patent is hereby corrected as shown below:

Title page,
Item [73], Assignee, change the assignee from "Apex Medical Corp., Hsi-Chin Taipei, Taiwan" to -- Apex Medical Corp., Taipei, Taiwan, R.O.C. and Tai Shin Plastic Co., Ltd., Taipei, Taiwan R.O.C. --.

Signed and Sealed this

Seventeenth Day of February, 2004

JON W. DUDAS
*Acting Director of the United States Patent and Trademark Office*